US005962088A

United States Patent [19]

Tanaka et al.

[11] Patent Number: 5,962,088

[45] Date of Patent: Oct. 5, 1999

[54] IMITATION TREES

[75] Inventors: Tamotu Tanaka, Ono; Yasuo Usui, Kato-gun, both of Japan

[73] Assignee: Tokusen Kogyo Co., Ltd., Ono, Japan

[21] Appl. No.: 08/799,025

[22] Filed: Feb. 10, 1997

[30] Foreign Application Priority Data

Mar. 28, 1996 [JP] Japan ..... 8-074387

[51] Int. Cl.[6] ..... A47G 33/06

[52] U.S. Cl. ..... 428/18; 428/378

[58] Field of Search ..... 428/18, 19, 20, 428/378

[56] References Cited

U.S. PATENT DOCUMENTS

| | | | |
|---|---|---|---|
| 1,514,788 | 11/1924 | Protz | 428/18 X |
| 2,216,440 | 10/1940 | Houle | 428/18 X |
| 4,612,219 | 9/1986 | Tengs et al. | 428/18 X |
| 5,712,035 | 1/1998 | Ohtaka et al. | 428/378 |

FOREIGN PATENT DOCUMENTS

| | | |
|---|---|---|
| 57-30401 | 6/1982 | Japan . |
| 57-082364 | 7/1982 | Japan . |
| 59-011300 | 1/1984 | Japan . |
| 7-108344 | 4/1995 | Japan . |

*Primary Examiner*—Henry F. Epstein
*Attorney, Agent, or Firm*—Browdy and Neimark

[57] ABSTRACT

An imitation tree is made by forming a trunk, roots, branches and leaves by using chiefly stranded wires as a material imitating a natural tree. The stranded wire which is a material may be a composite stranded wire obtained by stranding metal filaments and an optical fiber together, or may be obtained by stranding the same or different kinds of metal filaments selected from iron or an iron alloy, copper or a copper alloy, aluminum or an aluminum alloy and noble metals. The stranded wires are suitably subjected to the annealing or surface treatment such as coloring, plating, lustering, delustering or application of a fluorescent coating material. The stranded wires are bundled together to form a trunk, roots and branches, and the ends thereof are unstranded to form twigs, leaves, buds and blossoms. The metal filaments are unstranded from the stranded wires and, as required, ornaments such as artificial fruits and blossoms are attached by attaching beads which are ornamental materials supposed to be fruits and blossoms to the metal filaments.

11 Claims, 7 Drawing Sheets

IMITATION TREES

BACKGROUND OF THE INVENTION

1. Field of the Invention

The present invention relates to imitation trees made by using artificial materials to resemble natural trees.

2. Description of the Prior Art

Planting and growing a natural tree in a flowerpot require watering and cumbersome trimming. When the tree is displayed indoors, furthermore, the leaves fall causing the room to become dirty, the watering fouls the floor, and the tree must be moved to a place where it can be exposed to the sunshine requiring laborious work. In the case of a so-called bonsai (potted dwarf tree), the tree must be constantly deformed and pruned over long periods of time to realize graceful tree shape and appearance as desired. Even a skilled person finds it difficult to shape the trees as desired. In recent years, therefore, the demand for imitation trees has been increasing.

There has been proposed an imitation tree made by selectively cutting graceful portions from a natural pine tree or a cedar, joining them to a trunk or branches of another tree using an adhesive or by insertion or the like means, so that the tree may appear as a natural tree (e.g., Japanese Patent Publication No. 30401/1982, Japanese Patent Laid-Open No. 11300/1984). However, the imitation potted dwarf trees using natural trees without roots arouse problems of loss of strength and color fading due to withering of the trees. Moreover, the branches and leaves inevitably break and fall due to aged adhesive and deteriorated insertion. It has been attempted to apply resin coating material as means for preventing the drop of strength of the trees and color fading, which, however, is not perfect, and the drop of strength and color fading due to the passage of time are not avoidable.

There have further been proposed imitation trees which are made to resemble natural trees by using artificial materials such as wires, papers, cloths, plastics, synthetic resins, etc. The imitation trees using such artificial materials require none of pruning, watering, trimming, and are suited as indoor ornaments making it possible to easily realize a tree of any desired shape. Therefore, a person can easily enjoy the atmosphere of potted dwarf trees and can further enjoy making the imitation trees as a creative hobby. In this case, the imitation tree is produced by winding a color tape on a single wire, bundling such wires to form trunks and branches, attaching any desired ornamental materials such as fruits or blossoms to each branch, and finishing in any desired shape and color as disclosed in, for example, a microfilm of Japanese Utility Model Laid-Open No. 82364/1982. There has further been proposed an art according to which a metal mold is produced in advance for the whole tree or for part of the tree, and a molten synthetic resin or a cast iron is poured into the metal mold to mold the tree (e.g., see Japanese Patent Laid-Open No. 108344/1995).

However, the imitation trees using these artificial materials have their respective defects.

First, the former imitation tree uses a wire which is a single wire having a diameter of usually about 1 mm and serves simply as a core material for reinforcement. The wire itself produces no sense of beauty and must be wrapped with a color tape or the like material. Therefore, laborious work is required and, besides, the tree is ruggedly finished presenting only a rough expression. In this case, furthermore, the imitation tree is not capable of expressing fine texture of a natural tree and exhibits poor appearance.

In the case of the latter imitation tree molded by pouring a synthetic resin or a cast iron into the metal mold, the shapes of the tree and branches are determined by the metal mold, and the shape of the imitation tree cannot be changed unless the metal mold is changed. Changing the metal mold requires a considerable amount of cost. In practice, therefore, it is difficult to change the metal mold so frequently. Besides, the synthetic resin and the cast iron have poor plastic deformation which makes it difficult to artificially change the shape of the tree and of the branches after molded. Properly speaking, the imitation trees of this kind have a meaning in that they are finished in their own different shapes depending upon the idiosyncrasies of the persons who make them. Therefore, the above-mentioned imitation trees of which the shapes and branches cannot be changed (or can be changed with difficulty) fail to offer interest for both the persons who make them and the persons who enjoy watching them.

In any one of the above-mentioned imitation trees, when ornamental materials imitating fruits and blossoms are to be attached to the individual branches, minute work is required to attach materials such as fruits and blossoms to the individual branches using mounting means such as a bundling wire or an adhesive. In other words, cumbersome work is required, and knots of bundling wires and traces of adhesive appear conspicuously to deteriorate the sense of beauty.

OBJECTS AND SUMMARY OF THE INVENTION

The present invention was accomplished in order to solve problems inherent in the above-mentioned conventional imitation trees, and its object is to provide an imitation tree having increased strength, does not lose strength and color after the passage of time, permits the shape to be freely changed, offers the joy of tree-making, and makes it possible to attach the ornamental materials imitating fruits and blossoms easily and beautifully.

In order to solve the above-mentioned problems, an imitation tree is made by chiefly using stranded wires as a material and forming a trunk, roots, branches and leaves to resemble those of a natural tree. Moreover, at least the branches and leaves may be formed by using composite stranded wires obtained by stranding metal filament and optical fibers together. The metallic stranded wires may be those of the same kind or different kinds selected from iron or an iron alloy, copper or a copper alloy, aluminum or an aluminum alloy, and a noble metal such as gold or silver. Or, the stranded wires may be partly or entirely annealed. Or, the trunk, roots, branches and leaves may be subjected to the surface treatment such as coloring, plating, lustering, delustering, or coating with a fluorescent coating material. Moreover, the stranded wires may be bundled together to form a trunk, roots and branches, and the ends of the stranded wires may be untwisted to form branches, leaves, buds and blossoms. Furthermore, an optical fiber may be bundled together with the stranded wires, and ornaments such as artificial fruits and blossoms may be attached to the trunk, branches and leaves.

According to the present invention, the imitation tree is made by using a stranded wire as a chief material, forming the trunk, branches and roots using a plurality of the stranded wires, unstranding one or a plurality of metal filaments in the stranded wires forming branches, and attaching beads which are ornamental materials imitating fruits and blossoms to the metal filaments. Here, the trunk, branches and roots are formed by using a plurality of stranded wires obtained by stranding a plurality of metal filaments, and beads are attached to the wires by unstranding one or a plurality of metal filaments in the stranded wires forming branches.

The metal twisted wire used in the present invention is obtained by stranding together a plurality of metal filaments of the same kind or different kinds. Such a stranded wire is obtained by using a wire stranding machine of the buncher type or of the tubular type. Not being limited to the wire stranding machines of these types only, however, it is allowable to use the machine of any other type provided the stranded pattern is formed periodically and regularly.

The structure of the stranded wire may be either a single-layer stranded structure or a multi-layer stranded structure. The stranded wire having a diameter of about 0.5 to 2.0 mm is easy to handle. The wire may be thicker than 2.0 mm (e.g., 3 mm and 5 mm) requiring, however, a considerably large force for cutting and bending the stranded wire. The single-layer stranded structure can be expressed by a general formula 1×n (n is a natural number of not smaller than 2). Typical stranded structures will be 1×5, 1×7, 1×12, etc. The multi-layer stranded structure can be expressed by general formulas 1+n, m+n, m×n, m+n+p, etc. (m, n and p are natural numbers of not smaller than 2). Typical stranded structures will be 1+6, 3+6, 3+9, 4×4, 7×4, 3+9+15, etc.

In this case, the diameter of the metal filaments constituting the stranded wire can be suitably changed. In a stranded wire having a stranded structure 1+6, for example, a metal filament serving as a core may have a diameter larger than the surrounding strands.

It is further allowable to change the materials of the metal filaments constituting the stranded wire. In a stranded wire having a stranded structure 3+9+15, for example, the three core wires may be copper wires, the surrounding nine wires may be steel wires, and the fifteen wires on the outermost side may be brass wires. In making the imitation tree, furthermore, the end of the stranded wire may be unstranded to enjoy the colors and lusters of the metals.

According to the present invention, it is desired that the metal filament has a diameter within a range of from 0.10 to 0.40 mm because of the reasons that will be described below.

When at least one or more kinds of metals are used out of iron or an iron alloy, copper or a copper alloy, aluminum or an aluminum alloy and noble metals as materials of the wires, it is allowed to obtain features of the respective metals as will be described below in detail. An iron alloy is the one obtained by adding alloy elements to pure iron, and may be a stainless steel, a carbon steel or the like steel. A copper alloy may be a soft copper, a hard copper, a brass, or the like. An aluminum alloy may be the one obtained by adding such elements as Cu, Si, Mg, etc. to aluminum.

For example, iron or an iron alloy gives high strength, and copper or a copper alloy creates the atmosphere of bluish green moss grown on the surfaces thereof. Aluminum and an aluminum alloy are light in weight and are easy to handle. Noble metals such as gold and silver enhance artistic value and may create antique value in the future. Upon suitably combining these metals, a graceful tree can be made by utilizing the features of the metals.

Part or whole of a stranded wire, when annealed, can provide an increased flexibility for easier deformation. Especially, iron or iron alloy, which has high strength and toughness, will develop a significant effect when annealed.

By subjecting the metal filaments to the surface treatment such as plating, coloring, lustering, delustering or applying a fluorescent coating material, furthermore, a rich color tone can be obtained to enjoy enhanced degree of creativity. For example, a brass may be plated onto iron or an iron alloy, or a coloring material may be sprayed thereon to obtain various color tones. It is important that the surface treatment is carefully carried out so will not to impair the features of the metals which are the materials. Depending upon the manner of surface treatment, the value can be enhanced to a level of artistic handicraft and, besides, development of rust can be prevented.

The metal filaments are straightened to correct curves and undulations of the stranded wires. Thus, the wire art offers good looking and enhances the value of the work. When, for example, a number of stranded wires are bundled together to form a trunk, the stranded wires are neatly arranged in parallel offering excellent looking. The straightening can be accomplished by using a correction roller or by the rotary correction. The rotary correction, however, is preferred for achieving a high degree of straightening.

The imitation tree thus constituted has a trunk, roots, branches and leaves that are chiefly formed of stranded wires and features a sufficient degree of strength and a suitable degree of softness. Accordingly, the shapes of the trunk, branches and leaves can be freely changed to enjoy the tree making. Since stranded wires are used instead of a natural tree, the strength does not decrease and the color does not fade with the passage of time. When an imitation tree is made by using a composite stranded wire obtained by stranding wires and an optical fiber together to form at least branches and leaves, the optical fiber being arranged as a core of the composite stranded wire, the core emits light at portions where the composite stranded wire is cut, contributing to enhancing the sense of atmosphere.

The imitation tree of the present invention effectively utilizes the regularly stranded pattern of the stranded wire to create a particular atmosphere. That is, when light falls on the stranded wire, the stranded pattern is illuminated, bright portions and dark portions appear regularly maintaining a vivid contrast, presenting a sense of beauty. Besides, the stranded pattern, tint of the metal material and luster of the metal produce synergistic effect creating a deep atmosphere that cannot be achieved with the conventional imitation trees. Moreover, since fine metal filaments are stranded together to form a stranded wire, the strength of the metal and flexibility of the stranded wire can be utilized maintaining good balance. Thus, the stranded wire offers both traverse rupture strength and flexibility that are suited for making imitation trees.

The imitation tree has a trunk, roots and branches formed by bundling the stranded wires, and has branches, leaves, buds or blossoms formed by unstranding the ends of the stranded wires. Therefore, there is no need to join the trunk and branches, and branches and leaves by using an adhesive or by insertion unlike those of the conventional imitation trees. Therefore, the branches and leaves do not fall that was a problem in the prior art due to aged adhesive or insertion.

When the imitation tree is made of a bundle of the stranded wires and optical fibers, a light-emitting device may be connected to the optical fibers; i.e., the imitation tree can be used as an illumination at night or in a dark place or as an ornament in a hotel or in a hall.

When artificial ornaments such as fruits or blossoms are attached to the trunk, branches and leaves, the tree gives good appearance and enhanced ornamental value.

When the metal filaments unstranded from the stranded wire are passed through the holes of beads and are then fastened, the filaments for ornaments and the branches can be joined together without using a bundling wire unlike the conventional imitation trees. That is, since the metal filaments for attaching the beads are integral with the imitation tree, the beads can be easily attached to the branches by passing the metal filaments through the holes of the beads followed by simple fastening.

By using the metal filament having a diameter of from 0.10 to 0.40 mm, furthermore, the stranded wire obtained by bundling a plurality of such metal filaments exhibits well-balanced flexibility and traverse rupture strength. When the diameter lies outside this range, i.e., when the wire diameter is smaller than 0.10 mm, the metal filaments must be used in an increased number to maintain strength of the stranded wire and require cumbersome operation for unstranding the metal strands. Besides, since the metal filament is too thin, the shade becomes too fine and loses contrast. When the wire diameter is larger than 0.40 mm, on the other hand, the flexibility is lost, and fine and sophisticated atmosphere cannot be expressed. When the beads are fastened, furthermore, the fastened portions appear conspicuously to lose sense of beauty.

The above and other objects, features and advantages of the present invention will become apparent from the following detailed description which is to be read in conjunction with the accompanying drawings.

DESCRIPTION OF THE PREFERRED EMBODIMENTS

Embodiments of the invention will now be described with reference to the drawings.

(Embodiment 1)

Figure 3:
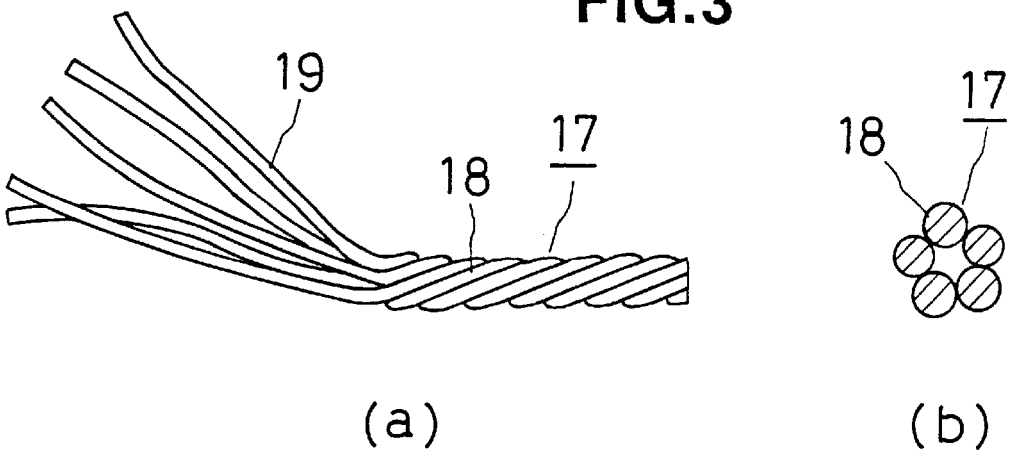
FIG. 3 illustrates a metal twisted wire for making the imitation tree of FIG. 1, wherein FIG. 3(*a*) is a view illustrating the unstranded state at an end on an enlarged scale, and FIG. 3(*b*) is a sectional view thereof on an enlarged scale.

Referring to FIG. 3(*b*) which is a sectional view of the structure, several kinds of stranded wires 17 having a stranded structure of 1×5 were prepared, each being obtained by stranding together five metal filaments 18 having a diameter of 0.25 mm. A hard steel, a stainless steel, a copper alloy and an aluminum alloy were selected as materials of the stranded wires 17.

Among the above various stranded wires, those made of a hard steel and a stainless steel were annealed to impart flexibility. The stranded wire made of a hard steel was plated with brass.

Described below is a method of finishing into the shape of a potted dwarf tree by using the above-mentioned various stranded wires. In this embodiment, the imitation potted dwarf tree was formed to resemble a pine tree.

Figure 2:
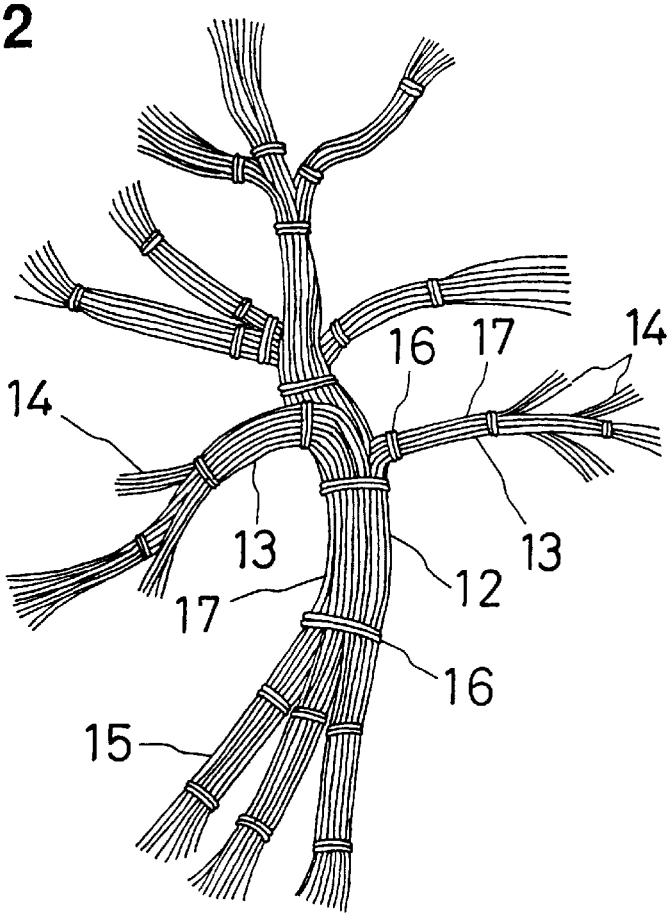
FIG. 2 is a view illustrating the steps for making the imitation tree of FIG. 1.

Referring, first, to FIG. 2, several hundreds of stranded wires 17 cut to suitable lengths were bundled to form a trunk 12. Then, branches 13 and roots 15 (i.e., sub-bundles) were branched from the trunk 12, and twigs 14 (i.e., sun-bundles) were branched from the branches 13. In making the tree, wires 16 were wound on major portions of the bundle of the stranded wires to prevent the shape from collapsing.

Stranded wires for forming leaves were suitably drawn from the bundles of stranded wires forming twigs 14, and the metal filaments 18 constituting the stranded wires 17 were unstranded as shown in FIG. 3(*a*) to form leaves 19. This operation was carried out roughly for almost all twigs. Then, the trunk, branches and twigs were adjusted for their curves and shapes to make an imitation potted dwarf tree 11 shown in FIG. 1. In this step, the wires 16 are still wound.

Figure 1:
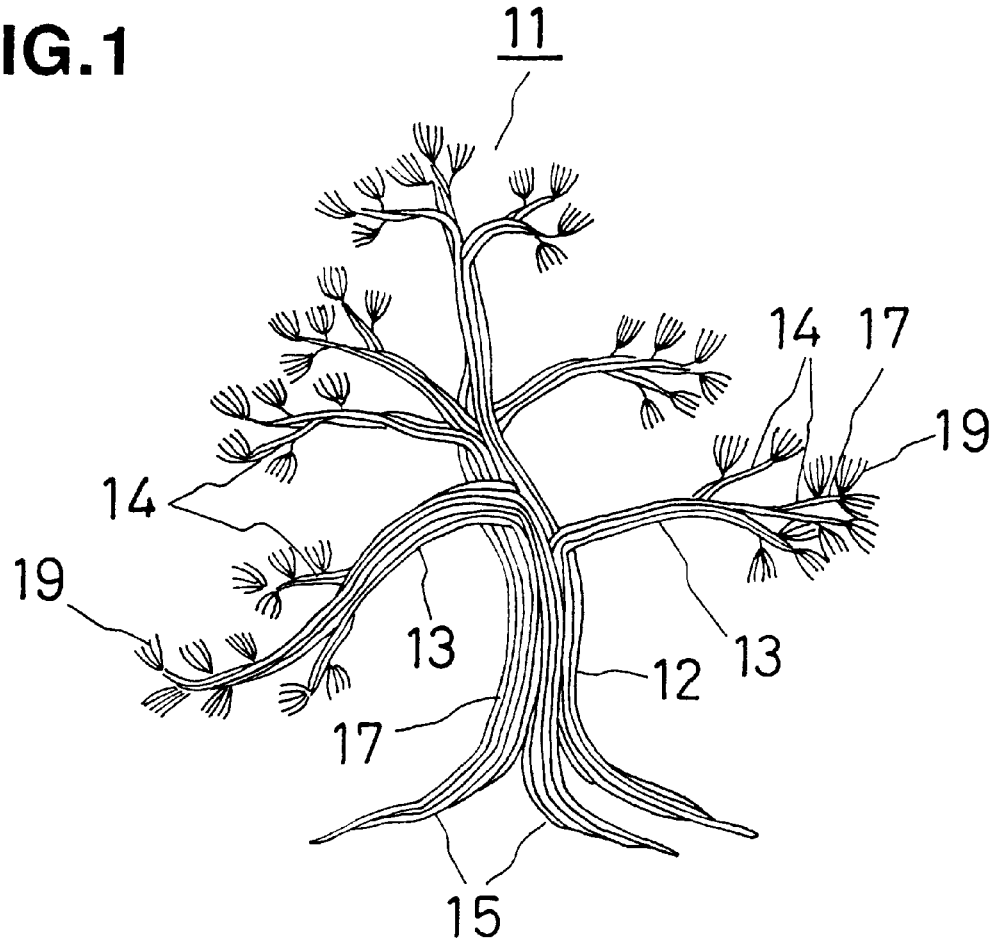
FIG. 1 is a view schematically illustrating an imitation tree according to an embodiment 1 of the present invention.

A transparent resin was applied onto the trunk 12, roots 15 and branches 13 of the imitation potted dwarf tree shown in FIG. 1. This is to secure the bundles of the stranded wires and to obtain luster so that the tree appears gracefully. A plurality of stranded wires constituting the twigs 14 were stranded together so that they will not be broken up. After the transparent resin has dried, the wires 16 were removed to finish the imitation potted dwarf tree 11. Then, the imitation potted dwarf tree 11 may be put in a suitable flowerpot.

In the embodiment 1, the bundles of the stranded wires were secured with the transparent resin and, then, the wires 16 were removed. When the transparent resin is not applied, however, the wires may be left wound. Even in the trunk 12, roots 15 and branches 13, the bundles of stranded wires may be stranded so that the bundles of the stranded wires will not be broken up despite the transparent resin is not applied.

The embodiment 1 has used stranded wires of a hard steel plated with brass. It is, however, also allowable to plate copper, bronze, nickel or the like instead of brass to enjoy different tastes.

By applying a green coating material to the leaves and applying a dark brown coating material to the trunk and branches, furthermore, the imitation potted dwarf tree looks more like a natural potted dwarf tree.

By rubbing the trunk and branches with a wire brush or a sandpaper to effect the delustering, furthermore, the whole imitation potted dwarf tree exhibits serene appearance as if it has endured wind and snow.

Optical fibers can be bundled together with the stranded wires. The optical fibers may be arranged in any number along the circumference of the bundle of the stranded wires, or may be wound on the trunk, branches and leaves after the imitation potted dwarf tree is completed, or may be bonded thereto.

Upon shining light of various colors such as red, blue, etc. onto the optical fibers from light-emitting devices, the imitation potted dwarf tree can be used as an illumination at night or in a dark room.

Ornaments such as artificial fruits and blossoms of various colors may be attached to the trunk, branches and leaves. It is desired that such ornaments are detachably attached (e.g., by magnets or hooks) so that they can be replaced depending upon the liking of a person.

(Embodiment 2)

Figure 4:
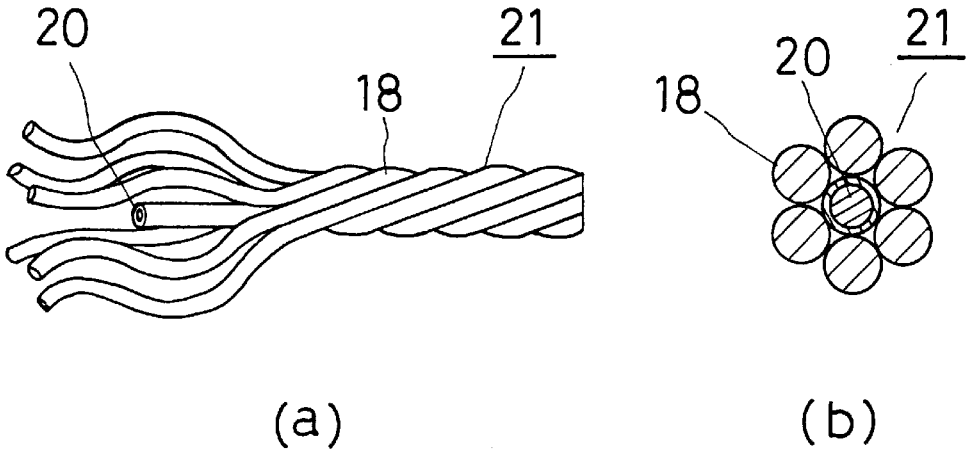
FIG. 4 illustrates a composite stranded wire for making an imitation tree according to an embodiment 2 of the present invention, wherein FIG. 4(*a*) is a view illustrating the unstranded state at an end on an enlarged scale, and FIG. 3(*b*) is a sectional view thereof on an enlarged scale.

Referring to FIG. 4(*b*) which is a sectional view illustrating the structure, a composite stranded wire 21 was obtained by stranding six metal filaments 18 around an optical fiber 20 as a core. The sectional shape of the composite stranded wire 21 is usually called 1+6 structure. The outer periphery of the optical fiber was coated with a resin for protecting the optical fiber.

By using this composite stranded wire 21, a potted dwarf tree was made by the same method as that of the embodiment 1. Then, as shown in FIG. 4(*a*), the composite stranded wires 21 were suitably drawn from the bundles of composite stranded wires constituting the twigs, and the metal filaments 18 at the end portions were unstranded. In this case, the optical fiber 20 is supposed to be the pistil, and the unstranded portions of the metal strands 18 are supposed to be petals or flower leaves.

In this embodiment, light of various colors is transmitted to the optical fiber 20 from a light-emitting device (not shown), and the optical fiber at the end of the composite stranded wire 21 emits light enabling a person to enjoy a tasteful atmosphere where a tree has blossomed.

The imitation tree according to the above embodiment 2 was made by using the composite stranded wires only. It is, however, also possible to use a required number of composite stranded wires for a portion of the material forming the imitation tree of the embodiment 1 in order to form at least the branches and leaves using composite stranded wires.

(Embodiment 3)

Figure 6:
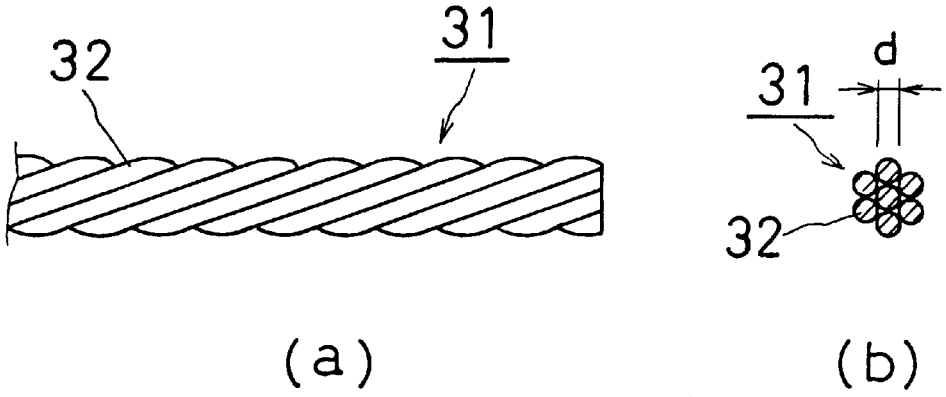
FIG. 6 illustrates a stranded wire for making the imitation tree of FIG. 5, wherein FIG. 6(*a*) is an enlarged side view and FIG. 6(*b*) is an enlarged sectional view.

Referring to FIG. 6, a stranded wire 31 having a stranded structure of 1×7 was obtained by stranding seven metal filaments 32 having a diameter d of 0.34 mm. FIG. 6(*a*) is an enlarged side view and FIG. 6(*c*) is an enlarged sectional view. A high-carbon steel (70C material) was used as a material of the metal wire 32, and a wire stranding machine of the buncher type was used. Brass was plated in advance onto the surfaces of the metal filaments.

Next, the stranded wire was passed through a continuous annealing furnace and was bright-annealed, and was then straightened through a rotary correcting machine and was cut into a predetermined size (50 cm).

Figure 7:
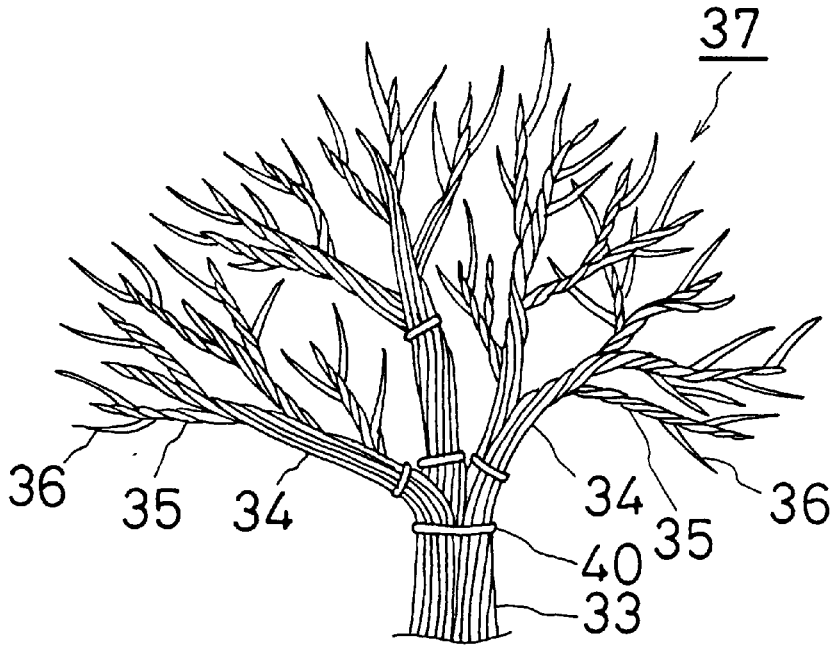
FIG. 7 is a view illustrating the steps for making the imitation tree of FIG. 5.

Next, described below with reference to FIG. 7 is a procedure for making an imitation tree by using the stranded wire 31. In this embodiment, the imitation tree was made to resemble "an ilex".

First, two hundred stranded wires 31 were bundled together to form a trunk 33, and branches 34 were roughly formed from the trunk 33. While the tree was being formed, wires 40 were wound on major portions of the bundles of the stranded wires to prevent the shape from collapsing. The wires 40 could be removed after the imitation tree has been made.

Twigs 35 were formed being branched from the branches 34, and small twigs 36 were formed being branched from the twigs 35. This operation was executed roughly for all branches and, at the same time, roots (not shown) were also formed. The trunk, branches, twigs and small twigs were adjusted for their curves and shapes to obtain a main body 37 of the imitation tree as shown in FIG. 7. The small twigs 36 were each formed by one stranded wire.

In carrying out these operations, a plurality of stranded wires constituting the branches 34 and twigs 35 were suitably stranded together to prevent them from being broken up.

Next, the operation was carried out to attach red beads supposed to be blossoms of an ilex to the small twigs. The procedure of this operation will now be described.

Figure 8:
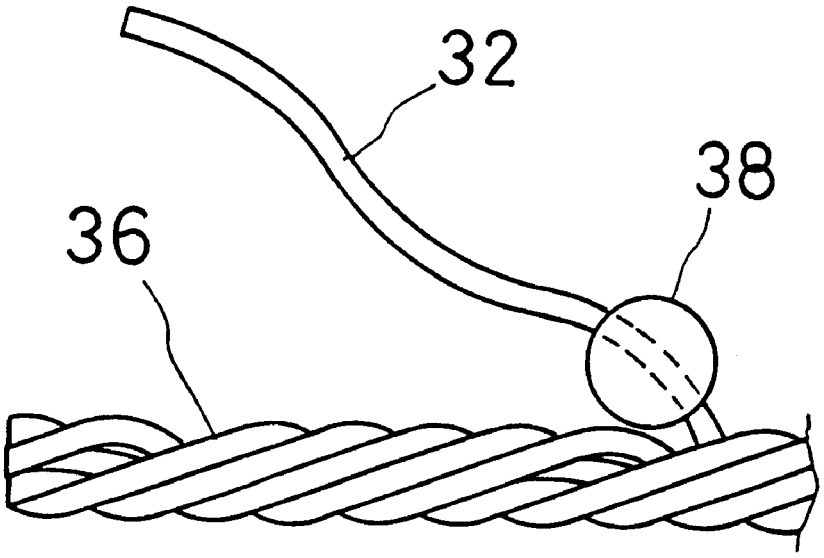
FIG. 8 is a view illustrating a state where metal filaments are unstranded from the stranded wire in a step of making the imitation tree of FIG. 5.
Figure 9:
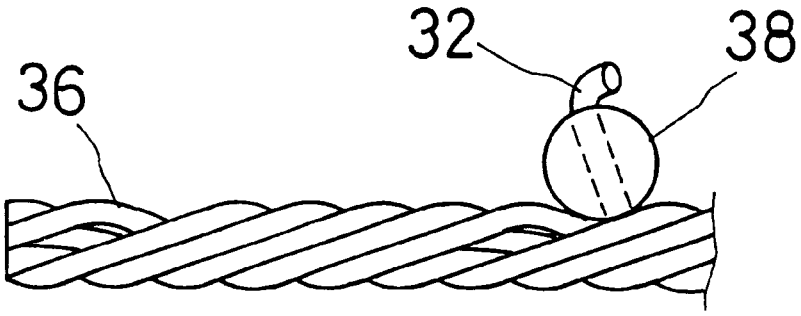
FIG. 9 is a diagram illustrating means for attaching beads to the imitation tree of FIG. 5.
Figure 10:
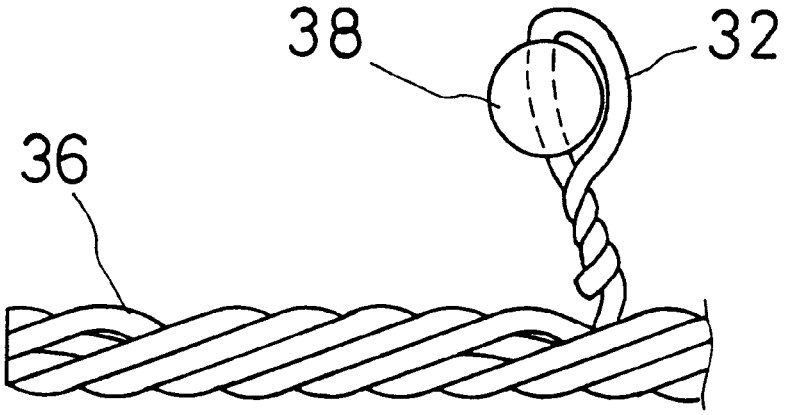
FIG. 10 is a diagram illustrating another means for attaching beads.

Referring, first, to FIG. 8, a metal filament 32 constituting a small twig 36 was turned in a direction opposite to the direction of twist to untwist the metal filament up to the root portion of the small twig 36. Next, the unstranded metal filament 32 was inserted through the hole of a bead 38 and was simply fastened to a degree that the bead 38 will not fall. The rest of the metal filament 32 was cut off.

Figure 5:
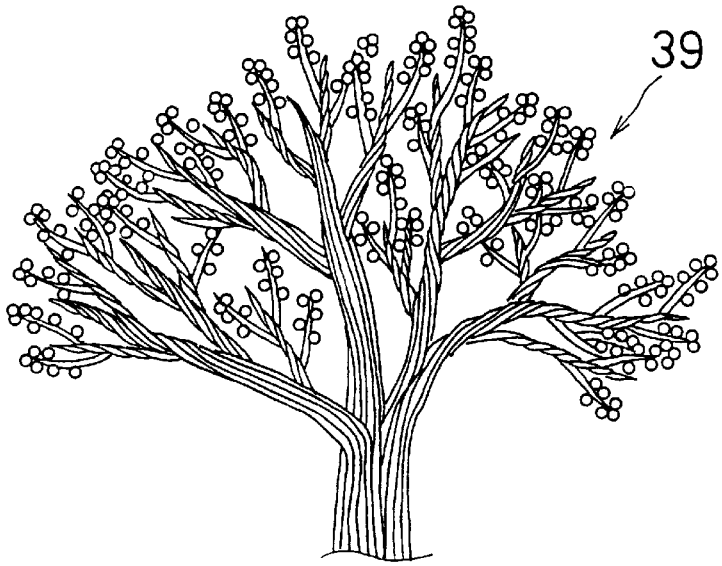
FIG. 5 is a view schematically illustrating an imitation tree according to an embodiment 3 of the present invention.

The above-mentioned operation was effected even for other small twigs to make an imitation tree 39 of "an ilexy" shown in FIG. 5.

The beads can be fastened in various ways as shown in FIGS. 9, 10, 11 and 12. In any way, the metal filament is as fine as 0.34 mm in diameter. Besides, no large knot is formed at the fastened portions, and the appearance of the imitation tree is not impaired.

Figure 11:
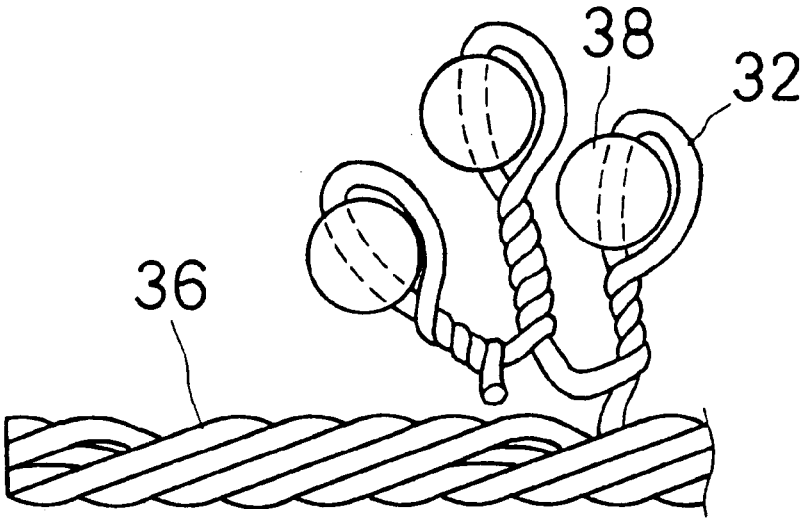
FIG. 11 is a diagram illustrating a further means for attaching beads.
Figure 12:
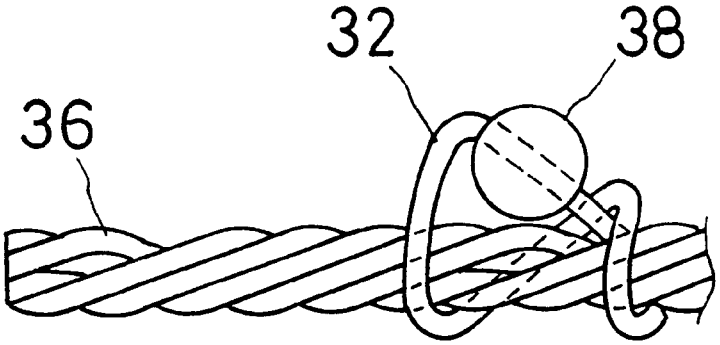
FIG. 12 is a diagram illustrating a still further means for attaching beads.

According to this embodiment, a plurality of beads 38 can be attached by using one metal filament 32 that is unstranded as shown in FIG. 11. Accordingly, the operation is very simplified, and the sense of beauty is not impaired, either.

It should be understood that we intend to cover by the appended claims all modifications falling within the true spirit and scope of our invention.

What is claimed is:

1. An imitation tree comprising: a tree trunk further comprising bundles of wire, the wire further comprising stranded filaments; the bundles being divided into sub-bundles comprising at least one wire.

2. An imitation tree comprising:

a tree trunk comprising a bundle of lengths of wire, the wire comprising stranded filaments;

tree branches comprising sub-bundles divided from the bundle;

tree sub-branches, twigs, or leaves comprising sub-sub-bundles divided from the sub-bundles.

3. The imitation tree according claim 2, wherein the wire comprises a metal filament, and the metal filament comprises a metal selected from the group consisting of iron, iron alloy, copper, copper alloy, aluminum, aluminum alloy, and a noble metal.

4. The imitation tree according to claim 3, wherein the wire further includes an optical fiber or optical fibers.

5. The imitation tree according to claim 2, wherein the wire is at least partly annealed.

6. The imitation tree according to claim 2, wherein at least one of the trunk, branches, sub-branches, and twigs have been at least partly subjected to a surface treatment.

7. The imitation tree according to claim 6, wherein the surface treatment is selected from the group consisting of coloring, plating, lustering, delustering, and application of a fluorescent coating material.

8. The imitation tree according to claim 2, wherein the leaves are formed by unstranding ends of wires.

9. The imitation tree according to claim 2, comprising ornaments selected from the group consisting of artificial fruits, artificial blossoms, and beads attached to the imitation tree.

10. The imitation tree according to claim 2, wherein the filaments have a diameter of from 0.10 mm to 0.40 mm.

11. The imitation tree according to claim 2, wherein the tree includes at least one root.

* * * * *